US008544151B2

(12) United States Patent
Courbon et al.

(10) Patent No.: US 8,544,151 B2
(45) Date of Patent: Oct. 1, 2013

(54) ENGAGING SURFACES ARRANGEMENT FOR A PIVOTING DETENT JOINT

(75) Inventors: Emmanuel Courbon, Columbia, SC (US); Yoann Cannistra, Montbeliard (FR)

(73) Assignee: Lang-Mekra North America, LLC, Ridgeway, SC (US)

( * ) Notice: Subject to any disclaimer, the term of this patent is extended or adjusted under 35 U.S.C. 154(b) by 177 days.

(21) Appl. No.: 13/301,937

(22) Filed: Nov. 22, 2011

(65) Prior Publication Data

US 2013/0125344 A1 May 23, 2013

(51) Int. Cl.
*E05D 11/10* (2006.01)

(52) U.S. Cl.
USPC ..... 16/334; 248/477

(58) Field of Classification Search
USPC ..... 16/334, 321, 330, 257, 259, 239, 16/229, 387; 248/476, 477, 478, 479, 549, 248/900; 359/841, 872, 877
See application file for complete search history.

(56) References Cited

U.S. PATENT DOCUMENTS

| | | | | |
|---|---|---|---|---|
| 3,637,186 | A * | 1/1972 | Greenfield | 248/478 |
| 4,101,227 | A | 7/1978 | Herbenar et al. | |
| 4,186,905 | A | 2/1980 | Brudy | |
| 4,824,065 | A | 4/1989 | Manzoni | |
| 6,590,725 | B2 | 7/2003 | Kho | |
| 6,637,898 | B2 * | 10/2003 | Hattori et al. | 359/841 |
| 7,137,715 | B2 | 11/2006 | Schuurmans et al. | |
| 7,261,272 | B2 | 8/2007 | Courbon | |
| 7,399,137 | B2 | 7/2008 | Schuurmans | |
| 7,445,191 | B2 | 11/2008 | Courbon | |
| 7,452,088 | B2 | 11/2008 | Brester et al. | |
| 7,490,946 | B1 | 2/2009 | Foote et al. | |
| 7,546,997 | B2 | 6/2009 | Van Stiphout | |
| 7,686,274 | B2 * | 3/2010 | Branham | 248/477 |
| 7,735,196 | B2 | 6/2010 | Centmayer et al. | |
| 7,878,477 | B2 * | 2/2011 | Courbon | 248/478 |
| 2008/0149803 | A1 * | 6/2008 | Yoshida et al. | 248/479 |
| 2009/0166505 | A1 * | 7/2009 | Courbon | 248/478 |
| 2009/0261226 | A1 * | 10/2009 | Branham | 248/477 |
| 2010/0296185 | A1 * | 11/2010 | Itoh et al. | 359/841 |
| 2011/0023271 | A1 * | 2/2011 | Shen | 16/334 |
| 2011/0083300 | A1 * | 4/2011 | Heger et al. | 16/321 |
| 2011/0181972 | A1 * | 7/2011 | Lewis | 359/841 |
| 2013/0015314 | A1 * | 1/2013 | Courbon | 248/479 |
| 2013/0092812 | A1 * | 4/2013 | Courbon et al. | 248/478 |

* cited by examiner

*Primary Examiner* — Jeffrey O Brien
(74) *Attorney, Agent, or Firm* — McNair Law Firm, P.A.; Seann P. Lahey

(57) ABSTRACT

A pivoting detent joint with selective positional engagement for a vehicle mirror assembly. The detent joint includes an arm detent ring defined by a continuous circular arrangement of a combination of arm locking teeth and alignment teeth. A base detent ring has a complementary arrangement to the arm detent ring and is defined by a continuous circular arrangement of a combination of base locking teeth and alignment channels. The arm locking teeth of the arm detent ring engage the base locking teeth of the base detent ring in a releasable interlocking engagement only when all of the alignment teeth are received into a complementary alignment channel so that positioning of a support arm relative to a carrier base is limited to specifically define orientations.

20 Claims, 4 Drawing Sheets

Fig. 3
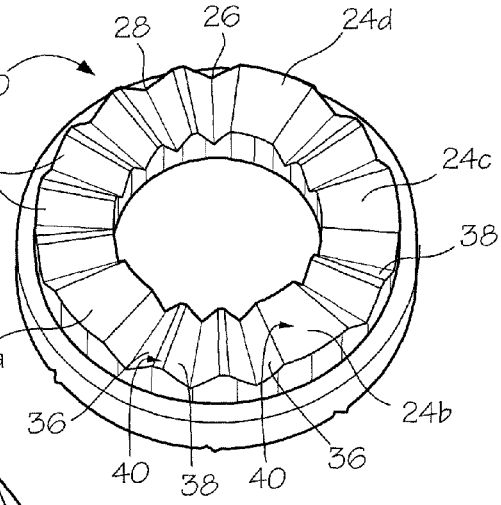
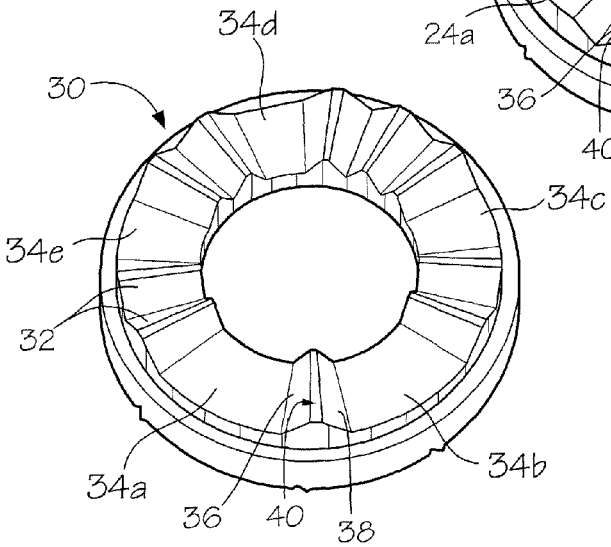
Fig. 4
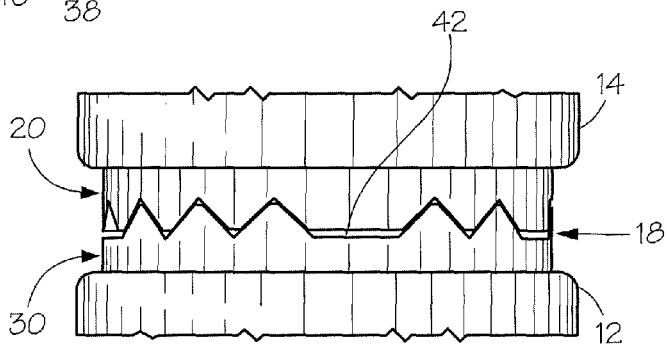
Fig. 5

ENGAGING SURFACES ARRANGEMENT FOR A PIVOTING DETENT JOINT

BACKGROUND OF THE INVENTION

1) Field of the Invention

The present invention relates to vehicle mirror assemblies, and more particularly, to a pivoting detent joint with selective engagement so that positioning of the support arm relative to the carrier base is limited to specific orientations.

2) Description of Related Art

Rearview mirror assemblies for vehicles, particularly for commercial trucks, exist in a wide variety of shapes and sizes. These various mirror assemblies include many different arrangements for mounting the mirror assemblies on the vehicles. On large, commercial vehicles, such as tractor-trailers and buses, a mirror head carrier the mirror glass is mounted on a support arm that extends the mirror head out from the side of the vehicle, thereby providing a clear view of different areas around the vehicle. A typical mounting arrangement includes the support arm mounted to a carrier base, which is affixed to the vehicle body.

A pivot joint may be included between the support arm and carrier base assembly to make it possible to swivel the support arm to position the mirror head at a preferred viewing position, and to move the mirror head from an operational position into a storage position essentially folded alongside the vehicle.

A problem arises when mirrors are not properly positioned as a results of excessively adjustability between the support arms and carrier base. A typical detent system allows for the support arm to lock in position relative to the carrier base at a multitude of positions, with one being only slightly different from the next. Returning the support arm and mirror head to the proper viewing position can become difficult with such extensive adjustability. In most modern mirror assemblies, because the mirror glass itself can be adjusted in the mirror head, the ability to adjust the support arm is not needed to adjust viewing angles. Thus, moving the support arm from a storage position to an operation position can lead to misalignment from the preferred viewing angle by the vehicle driver when the detent arrangement allows excessive adjustment possibilities.

Accordingly, it is an object of the present invention to provide a pivoting detent joint for a mirror assembly with selective engagement so that positioning of the support arm relative to the carrier base is limited to only a few specific orientations.

SUMMARY OF THE INVENTION

The above objective is accomplished according to the present invention by providing a mirror assembly having a pivoting detent joint with selective positional engagement, comprising a carrier base for mounting to the vehicle; a support arm carrying a mirror head and being pivotally mounted to the carrier base; an arm detent ring carried by the support arm; the arm detent ring defined by a continuous circular arrangement of a combination of arm locking teeth and alignment teeth, wherein any one of the alignment teeth occupies a larger portion of the arm detent ring than any one of the arm locking teeth; a base detent ring carried by the carrier base; and, the base detent ring having a complementary arrangement to the arm detent ring and defined by a continuous circular arrangement of a combination of base locking teeth and alignment channels, wherein any one of the alignment channels defines a portion of the base detent ring able to receive at least any one of the alignment teeth; whereby the arm locking teeth of the arm detent ring engage the base locking teeth of the base detent ring in a releasable interlocking engagement only when all of the alignment teeth are received into a complementary alignment channel so that positioning of the support arm relative to the carrier base is limited to specific orientations.

In a further embodiment, each of the alignment teeth of the arm detent ring are generally equal in footprint to the space occupied in the arm detent ring by at least two of the arm locking teeth.

In a further embodiment, the arm detent ring includes a mixed arrangement of four alignment teeth and nine arm locking teeth defining the arm detent ring.

In a further embodiment, the alignment teeth and arm locking teeth are arranged in a consecutive order of a first alignment tooth followed by two arm locking teeth, a second alignment tooth, a single arm locking tooth, a third alignment tooth, another single arm locking tooth, a fourth alignment tooth, and then five more arm locking teeth to complete the arm detent ring.

In a further embodiment, each of the arm locking teeth, the base locking teeth, and the alignment teeth have an exterior surface generally defined by a pair of angled sidewalls interconnected by a plateau surface forming a flat distal end for each arm locking tooth, base locking tooth, and alignment tooth.

In a further embodiment, engagement of the arm locking teeth and the alignment teeth with the base locking teeth and the alignment channels is limited to the angled sidewalls of each tooth such that a wear gap is defined between the plateau surface of a given tooth and one of the arm detent ring and the base detent ring.

In a further embodiment, each of the alignment channels of the base detent ring is defined by an absence of at least one of the base locking teeth such that any one of the alignment channels has a footprint in the base detent ring at least equal to one of the base locking teeth.

In a further embodiment, the alignment channels include a plurality of regular alignment channels able to receive any one of the alignment teeth or two of the arm locking teeth.

In a further embodiment, the regular alignment channels have a footprint in the base detent ring equal to one of the base locking teeth.

In a further embodiment, the alignment channels include a plurality of extended alignment channels able to receive any one of the alignment teeth plus one of the arm locking teeth or three of the arm locking teeth.

In a further embodiment, the extended alignment channels have a footprint in the base detent ring equal to two of the base locking teeth.

In a further embodiment, the base detent ring includes a mixed arrangement of five alignment channels and ten base locking teeth defining the base detent ring.

In a further embodiment, the base locking teeth and alignment channels are arranged in a consecutive order of a first alignment channel followed by a single base locking tooth, a second alignment channel, two base locking teeth, a third alignment channel, three base locking teeth, a fourth alignment channel, two base locking teeth, a fifth alignment channel, and then two more base locking teeth to complete the base detent ring.

In a further embodiment, the first and second alignment channels are extended alignment channels having a larger footprint in the base detent ring than the third, fourth and fifth alignment channels.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 3 shows a detailed perspective view of the arm detent ring according to the present invention;

FIG. 4 shows a detailed perspective view of the base detent ring according to the present invention;

FIG. 5 shows a side elevation view of the engagement between the arm detent ring and base detent ring according to the present invention; and, FIGS. 6*a*-6*c* show a top view of the alignment teeth arrangement of the arm detent ring received in the alignment channels of the base detent ring for selected positions according to the present invention.

The objects and features of the invention will become more fully apparent when the following detailed description is read in conjunction with the accompanying figures. However, it is to be understood that both the foregoing summary of the invention and the following detailed description are not restrictive of the invention or other alternate embodiments of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below.

DETAILED DESCRIPTION OF A PREFERRED EMBODIMENT

Figure 1:
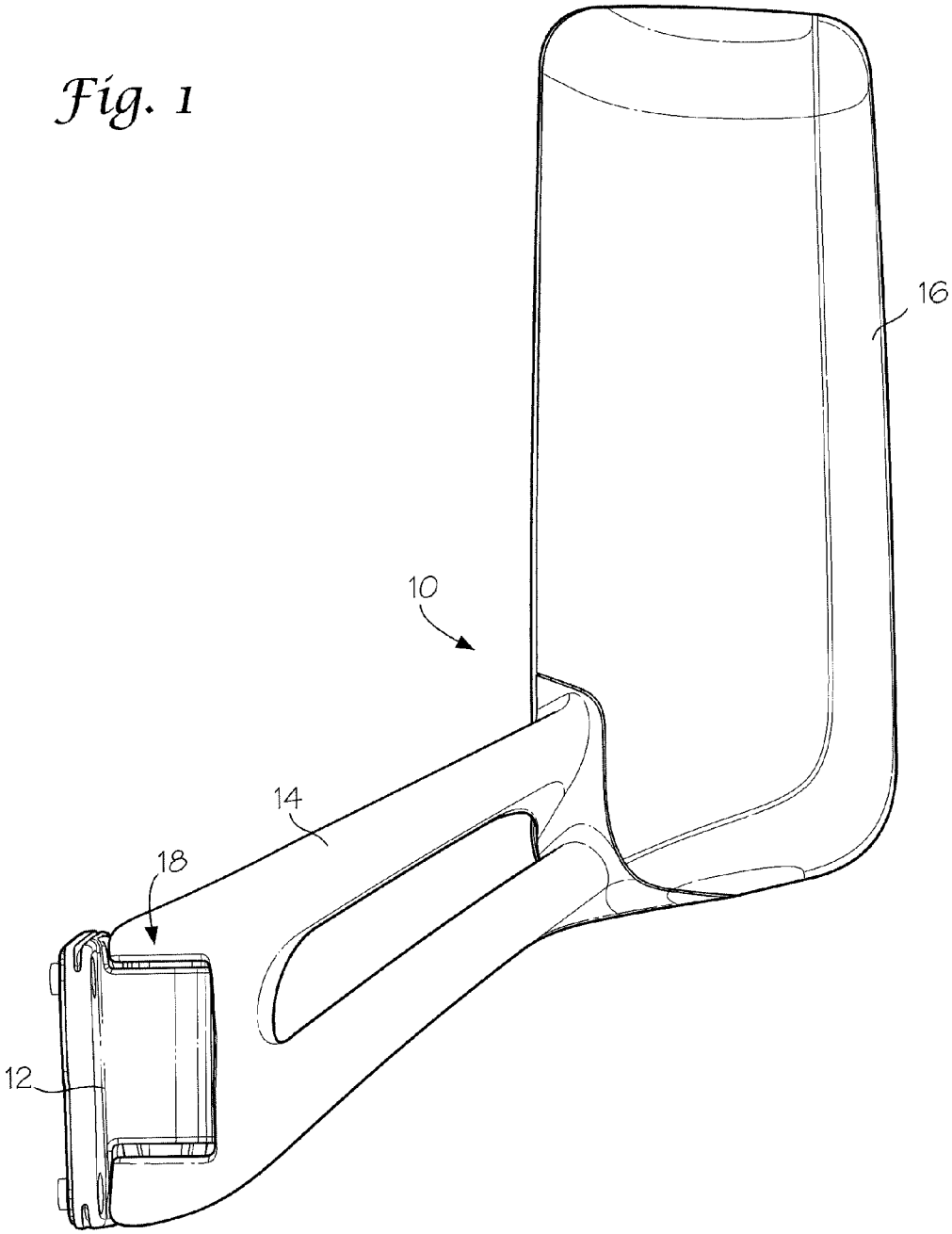
FIG. 1 shows a perspective view of a mirror assembly having a pivoting detent joint according to the present invention.

With reference to the drawings, the invention will now be described in more detail. Referring to FIG. 1, in the illustrated embodiment of the invention, an exterior vehicle mirror assembly 10 is shown having a carrier base 12 adapted for mounting to the side of a vehicle. A mirror head 16 is carried by a support arm 14. Mirror head 16 housing the mirror glass and components for displaying images to the driver. Support arm 14 is mounted to carrier base 12. A pivoting detent joint, designated generally as 18, is provided to control movement of support arm 14 in relation to carrier base 12.

Figure 2:
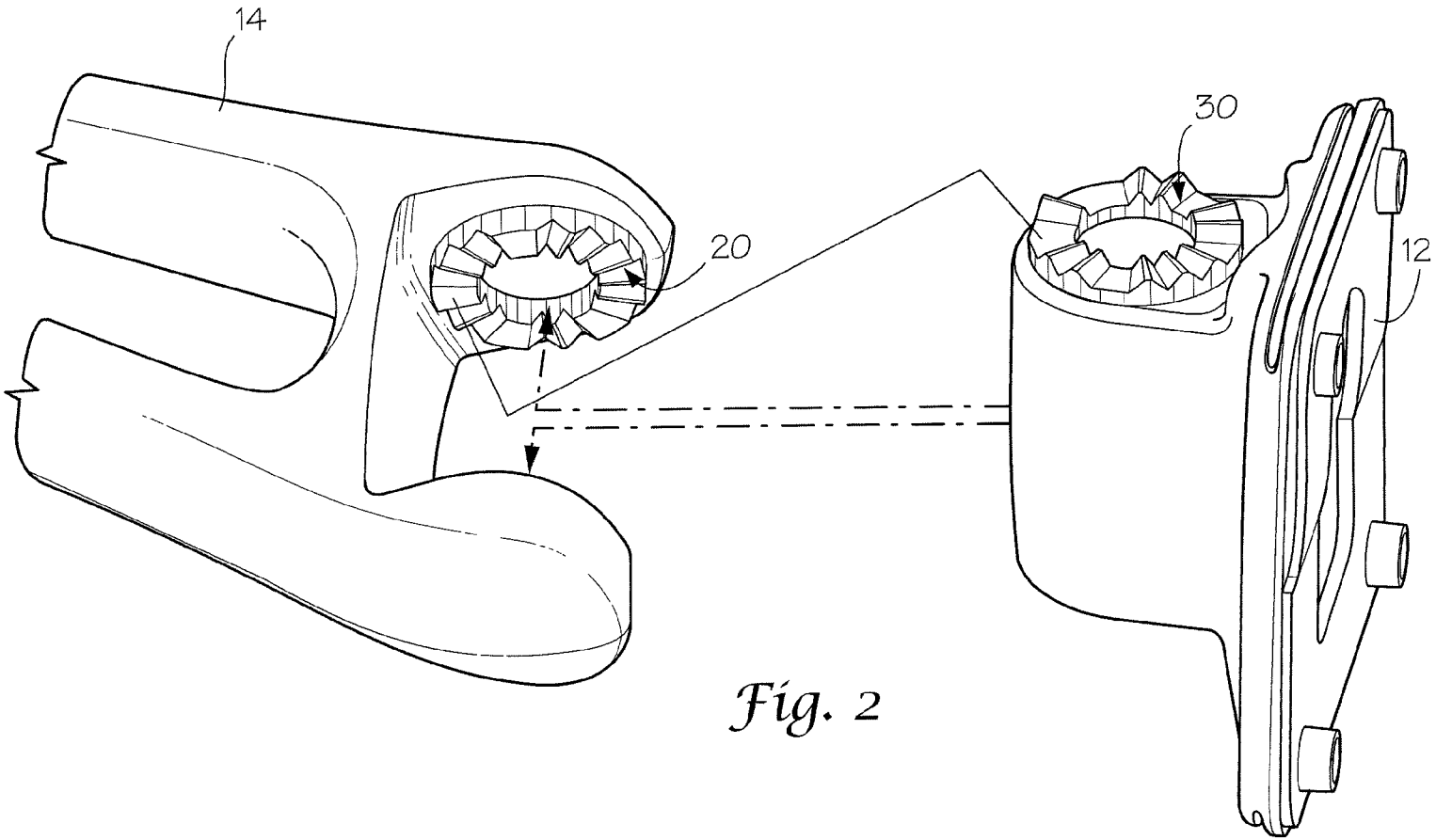
FIG. 2 shows an exploded perspective view of the engaging surface of the detent joint between the support arm and carrier base according to the present invention.

Referring to FIGS. 2 and 3, pivoting detent joint 18 includes an arm detent ring 20 carried by support arm 14. Arm detent ring 20 is defined by a continuous circular arrangement of a combination of arm locking teeth 22 and alignment teeth 24*a*-24*d*. In relation to each other, any one of alignment teeth 24*a*-24*d* occupies a larger portion of arm detent ring 20 than any one of arm locking teeth 22. In the preferred illustrated embodiment, each of alignment teeth 24*a*-24*d* of arm detent ring 20 are generally equal in footprint to the space occupied in arm detent ring 20 by at least two of arm locking teeth 22. The footprint of a tooth is defined as extending from a first bottom edge 26 to a second bottom edge 28. In the illustrated embodiment, arm detent ring 20 includes a mixed arrangement of four alignment teeth 24*a*-24*d* and nine arm locking teeth 22 defining the complete arm detent ring 20.

Referring to FIGS. 2 and 4, a base detent ring 30 is carried by the carrier base 12. Base detent ring 30 has a complementary arrangement to arm detent ring 20 and is accordingly defined by a continuous circular arrangement of a combination of base locking teeth 32 and alignment channels 34*a*-34*e*. For cooperating with arm detent ring 20, any one of alignment channels 34*a*-34*e* defines a portion of base detent ring 30 able to receive at least any one of alignment teeth 24*a*-24*d*. Each of alignment channels 34*a*-34*e* of base detent ring 30 is defined by an absence of at least one of the base locking teeth 32, such that any one of alignment channels 34*a*-34*e* has a footprint in base detent ring 30 at least equal to the footprint of one of base locking teeth 32. In the illustrated embodiment, base detent ring 30 includes a mixed arrangement of five alignment channels 34*a*-34*e* and ten base locking teeth 32 defining base detent ring 30.

As best shown in FIG. 4, the illustrated embodiment shows alignment channels 34*a*-34*e* that differ in the size of their footprint within base detent ring 30. Preferably, alignment channels 34*a*-34*e* include a plurality of regular alignment channels 34*c*, 34*d* and 34*e* able to receive any one of alignment teeth 24*a*-24*d* or two of arm locking teeth 22. In the preferred illustrated embodiment, regular alignment channels 34*c*, 34*d* and 34*e* have a footprint in base detent ring 30 equal to the footprint of one of base locking teeth 32.

Alignment channels 34*a*-34*e* further include a plurality of extended alignment channels 34*a* and 34*b* able to receive any one of alignment teeth 24*a*-24*d* plus one of arm locking teeth 22, or three of arm locking teeth 22. In the preferred illustrated embodiment, extended alignment channels 34*a* and 34*b* have a footprint in base detent ring 30 equal to the footprint of two of base locking teeth 32.

To provide for the selective engagement of only a few locking positions as described further herein below, the arrangement of the teeth between the arm detent ring 20 and base detent ring 30 must be specifically ordered. In the preferred embodiment, alignment teeth 24*a*-24*d* and arm locking teeth 22 are arranged in a consecutive order of a first alignment tooth 24*a* followed by two arm locking teeth 22, a second alignment tooth 24*b*, a single arm locking tooth 22, a third alignment tooth 24*c*, another single arm locking tooth 22, a fourth alignment tooth 24*d*, and then five more arm locking teeth 22 to complete arm detent ring 20. Base locking teeth 32 and alignment channels 34*a*-34*e* are arranged in a consecutive order of a first alignment channel 34*a* followed by a single base locking tooth 32, a second alignment channel 34*b*, two base locking teeth 32, a third alignment channel 34*c*, three base locking teeth 32, a fourth alignment channel 34*d*, two base locking teeth 32, a fifth alignment channel 34*e*, and then two more base locking teeth 32 to complete base detent ring 30. Preferably, first and second alignment channels 34*a* and 34*b* are the extended alignment channels as noted above having a larger footprint in base detent ring 30 than the third, fourth and fifth alignment channels.

Figure 6A:
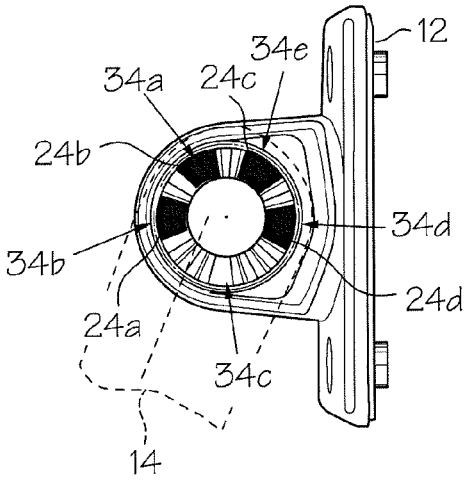
Figure 6B:
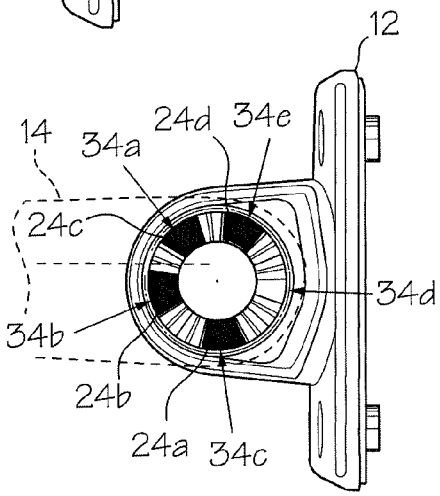
Figure 6C:
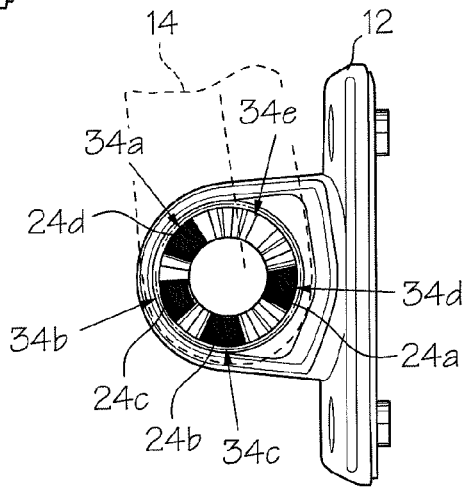

Referring to FIGS. 6*a*-6*c*, arm locking teeth 22 of arm detent ring 20 engage base locking teeth 32 of base detent ring 30 in a releasable interlocking engagement only when all of alignment teeth 24*a*-24*d* are received into a complementary alignment channel 34*a*-34*e* so that positioning of support arm 14 relative to carrier base 12 is limited to only a few specific orientations. Accordingly, when the specifically illustrated arrangement of arm locking teeth 22 and alignment teeth 24*a*-24*d* are combined with the specific ordering of complementary base locking teeth 32 and alignment channels 34*a*-34*e* of base detent ring 30 as detailed above, selective engagement of detent joint 18 is accomplished so that support arm 14 can only be locked relative to carrier base 12 in one of three positions. In the illustrated embodiment of a left side drivers rearview mirror, the three positions include a rearward folded position represented in FIG. 6*a*, an operation position for viewing by the driver represented in FIG. 6*b*, and a forward folded position represented in FIG. 6*c*. As shown in the FIGS. 6*a*-6*c*, the darkened sections represent the alignment teeth received in a respective alignment channel 34*a*-34*e*.

Referring to FIG. 6*a*, in the rearward folded position, the sequence of teeth engagement is as follows: alignment tooth 24*b* is received into alignment channel 34*a*, alignment tooth 24*a* is received into alignment channel 34*b*, alignment tooth 24*c* is received into alignment channel 34*e*, alignment tooth 24*d* is received into alignment channel 34*d*, and alignment channel 34*c* only receives arm locking teeth 22, wherein the arm detent ring locks into the base detent ring to hold support arm 14 relative to carrier base 12 in the rearward folded position.

Referring to FIG. 6*b*, in the operation position, the sequence of teeth engagement is as follows: alignment tooth 24*a* is received into alignment channel 34*c*, alignment channel 34*d* only receives arm locking teeth 22, alignment tooth 24*d* is received into alignment channel 34*e*, alignment tooth 24*c* is received into alignment channel 34*a*, and, alignment tooth 24*b* is received into alignment channel 34*b*, wherein the arm detent ring locks into the base detent ring to hold support arm 14 relative to carrier base 12 in the operation position.

Referring to FIG. 6*c*, in the forward folded position, alignment tooth 24*b* is received into alignment channel 34*c*, alignment tooth 24*a* is received into alignment channel 34*d*, alignment channel 34*e* only receives arm locking teeth 22, alignment tooth 24*d* is received into alignment channel 34*a*, and, alignment tooth 24*c* is received into alignment channel 34*b*, wherein the arm detent ring locks into the base detent ring to hold support arm 14 relative to carrier base 12 in the forward folded position.

In any intermediate position not specifically described as one of the above three positions, the plateau surfaces 40 of the alignment teeth 24*a*-24*d* will rest on top of the base locking teeth 32 to prevent engagement between arm detent ring 20 and base detent ring 30 for pivoting support arm 14 relative to carrier base 12. Further, while the illustrated embodiment shows the arm detent ring 20 including the alignment teeth and the base detent ring 30 included the alignment channels, the opposite arrangement can be provided to the same effect.

Referring to FIGS. 3, 4 in the preferred illustrated embodiment, each of arm locking teeth 22, base locking teeth 32, and alignment teeth 24*a*-24*d* have an exterior surface generally defined by a pair of angled sidewalls 36 and 38 interconnected by a plateau surface 40 forming a flat distal end for each arm locking tooth, base locking tooth, and alignment tooth. Referring to FIG. 5, engagement of arm locking teeth 22 and alignment teeth 24*a*-24*d* with base locking teeth 32 and alignment channels 34*a*-34*e* is limited to the angled sidewalls 36 and 38 of each tooth against another such that a wear gap 42 is defined between the plateau surfaces 40 of the teeth and the adjoining arm detent ring or base detent ring, respectively. Accordingly, as the angled sidewalls 36 and 38 wear into each other, the wear gap 42 allows for a continued uniform engagement and resists loosening of the pivot joint detent surfaces.

While a preferred embodiment of the invention has been described using specific terms, such description is for illustrative purposes only, and it is to be understood that changes and variations may be made without departing from the spirit or scope of the following claims.

What is claimed is:

1. A mirror assembly having a pivoting detent joint, comprising:

a carrier base for mounting to a vehicle;

a support arm carrying a mirror head and being pivotally mounted to said carrier base;

an arm detent ring carried by said support arm;

said arm detent ring defined by a continuous circular arrangement of a combination of arm locking teeth and alignment teeth, wherein any one of said alignment teeth occupies a larger portion of said arm detent ring than any one of said arm locking teeth;

a base detent ring carried by said carrier base; and, said base detent ring having a complementary arrangement to said arm detent ring and defined by a continuous circular arrangement of a combination of base locking teeth and alignment channels, wherein any one of said alignment channels defines a portion of said base detent ring able to receive at least any one of said alignment teeth;

whereby said arm locking teeth of said arm detent ring engage said base locking teeth of said base detent ring in a releasable interlocking engagement only when all of said alignment teeth are received into a complementary alignment channel so that positioning of said support arm relative to said carrier base is limited to specific orientations.

2. The mirror assembly of claim 1 wherein each of said alignment teeth of said arm detent ring are generally equal in footprint to the space occupied in said arm detent ring by at least two of said arm locking teeth.

3. The mirror assembly of claim 1 wherein said arm detent ring includes a mixed arrangement of four alignment teeth and nine arm locking teeth defining said arm detent ring.

4. The mirror assembly of claim 3 wherein said alignment teeth and arm locking teeth are arranged in a consecutive order of a first alignment tooth followed by two arm locking teeth, a second alignment tooth, a single arm locking tooth, a third alignment tooth, another single arm locking tooth, a fourth alignment tooth, and then five more arm locking teeth to complete said arm detent ring.

5. The mirror assembly of claim 1 wherein each of said arm locking teeth, said base locking teeth, and said alignment teeth have an exterior surface generally defined by a pair of angled sidewalls interconnected by a plateau surface forming a flat distal end for each arm locking tooth, base locking tooth, and alignment tooth.

6. The mirror assembly of claim 5 wherein engagement of said arm locking teeth and said alignment teeth with said base locking teeth and said alignment channels is limited to said angled sidewalls of each tooth such that a wear gap is defined between said plateau surface of a given tooth and one of said arm detent ring and said base detent ring.

7. The mirror assembly of claim 1 wherein each of said alignment channels of said base detent ring is defined by an absence of at least one of said base locking teeth such that any one of said alignment channels has a footprint in said base detent ring at least equal to one of said base locking teeth.

8. The mirror assembly of claim 1 wherein said alignment channels include a plurality of regular alignment channels able to receive any one of said alignment teeth or two of said arm locking teeth.

9. The mirror assembly of claim 8 wherein said regular alignment channels have a footprint in said base detent ring equal to one of said base locking teeth.

10. The mirror assembly of claim 1 wherein said alignment channels include a plurality of extended alignment channels able to receive any one of said alignment teeth plus one of said arm locking teeth or three of said arm locking teeth.

11. The mirror assembly of claim 10 wherein said extended alignment channels have a footprint in said base detent ring equal to two of said base locking teeth.

12. The mirror assembly of claim 1 wherein said base detent ring includes a mixed arrangement of five alignment channels and ten base locking teeth defining said base detent ring.

13. The mirror assembly of claim 12 wherein said base locking teeth and alignment channels are arranged in a consecutive order of a first alignment channel followed by a single base locking tooth, a second alignment channel, two base locking teeth, a third alignment channel, three base locking teeth, a fourth alignment channel, two base locking teeth, a fifth alignment channel, and then two more base locking teeth to complete said base detent ring.

14. The mirror assembly of claim 13 wherein said first and second alignment channels are extended alignment channels having a larger footprint in said base detent ring than said third, fourth and fifth alignment channels.

15. A pivoting detent joint with selective positional engagement for a vehicle mirror assembly, comprising:

an arm detent ring defined by a continuous circular arrangement of a combination of arm locking teeth and alignment teeth, wherein any one of said alignment teeth occupies a larger portion of said arm detent ring than any one of said arm locking teeth; and, a base detent ring having a complementary arrangement to said arm detent ring and defined by a continuous circular arrangement of a combination of base locking teeth and alignment channels, wherein any one of said alignment channels defines a portion of said base detent ring able to receive at least any one of said alignment teeth;

whereby said arm locking teeth of said arm detent ring engage said base locking teeth of said base detent ring in a releasable interlocking engagement only when all of said alignment teeth are received into a complementary alignment channel.

16. The pivoting detent joint of claim 15 wherein each of said alignment teeth of said arm detent ring are generally equal in footprint to the space occupied in said arm detent ring by at least two of said arm locking teeth.

17. The pivoting detent joint of claim 15 wherein said alignment teeth and arm locking teeth are arranged in a consecutive order of a first alignment tooth followed by two arm locking teeth, a second alignment tooth, a single arm locking tooth, a third alignment tooth, another single arm locking tooth, a fourth alignment tooth, and then five more arm locking teeth to complete said arm detent ring.

18. The pivoting detent joint of claim 15 wherein each of said alignment channels of said base detent ring is defined by an absence of at least one of said base locking teeth such that any one of said alignment channels has a footprint in said base detent ring at least equal to one of said base locking teeth.

19. The pivoting detent joint of claim 15 wherein said base locking teeth and alignment channels are arranged in a consecutive order of a first alignment channel followed by a single base locking tooth, a second alignment channel, two base locking teeth, a third alignment channel, three base locking teeth, a fourth alignment channel, two base locking teeth, a fifth alignment channel, and then two more base locking teeth to complete said base detent ring.

20. The pivoting detent joint of claim 19 wherein said first and second alignment channels are extended alignment channels having a larger footprint in said base detent ring than said third, fourth and fifth alignment channels.

* * * * *